US012538969B2

(12) United States Patent
Baranowski et al.

(10) Patent No.: US 12,538,969 B2
(45) Date of Patent: Feb. 3, 2026

(54) APPARATUS FOR HOLDING NAIL POLISH BOTTLES

(71) Applicants: Brad Baranowski, Franklin, WI (US); Andrea Baranowski, Franklin, WI (US)

(72) Inventors: Brad Baranowski, Franklin, WI (US); Andrea Baranowski, Franklin, WI (US)

( * ) Notice: Subject to any disclaimer, the term of this patent is extended or adjusted under 35 U.S.C. 154(b) by 350 days.

(21) Appl. No.: 18/494,693

(22) Filed: Oct. 25, 2023

(65) Prior Publication Data

US 2025/0134230 A1 May 1, 2025

(51) Int. Cl.
*A45D 29/00* (2006.01)

(52) U.S. Cl.
CPC ..... *A45D 29/00* (2013.01)

(58) Field of Classification Search
CPC ..... A45D 29/18; A45D 29/22; A45D 29/11; A45D 29/00; A47F 7/283; A47F 7/28; A47G 23/0608; A45C 11/34
USPC ..... 248/346.03, 314; 211/74; 108/43; D28/61, 56, 62, 73, 86, 20, 76, 99, 10, D28/57, 38, 64.2, 77; D3/313, 304; 132/314, 73
See application file for complete search history.

(56) References Cited

U.S. PATENT DOCUMENTS 2,659,920 A 11/1953 Bogan et al.
2,842,141 A 7/1958 Rodrigues
4,296,766 A 10/1981 Benis
5,326,056 A * 7/1994 Smith ..... A45D 29/22 132/73
5,892,499 A * 4/1999 Vulk, Jr. ..... G06F 3/0395 345/157
5,913,312 A * 6/1999 Donnell ..... A45D 34/00 132/73
6,035,857 A * 3/2000 Hartelius ..... A45D 29/20 132/73
6,102,204 A * 8/2000 Castleberry ..... B65D 85/52 47/65.5
6,202,862 B1 * 3/2001 Acquaviva ..... B43K 21/003 211/69.5
6,371,131 B1 * 4/2002 Finocchiaro ..... A45D 34/00 132/297
7,273,197 B1 * 9/2007 Huggins ..... B60T 3/00 248/346.06
D584,845 S * 1/2009 Chen ..... D26/81
8,789,541 B1 * 7/2014 Evans ..... B65D 81/113 132/73
D815,518 S * 4/2018 Safdie ..... D9/414
(Continued)

*Primary Examiner* — Tatiana L Nobrega
*Assistant Examiner* — Sarah Woodhouse
(74) *Attorney, Agent, or Firm* — James Earl Lowe, Jr.

(57) ABSTRACT

A nail grooming apparatus comprising a flexible foam base having an upper surface and a lower surface. The upper surface has a plurality of slots configured thereon, the plurality of slots being adapted to each receive and secure therein a nail polish bottle in a utilization state of the nail polish bottle. The base of the nail grooming apparatus has an oval end view flat on the lower surface and convex on the upper surface, a bean shaped top view convex on one side and concave on the opposite side, and a banana shaped side view with a flattened bottom surface with upturned ends and a slightly concave upper surface. The top surface has an inner central oval area, the inner central oval area having a design feature.

6 Claims, 7 Drawing Sheets

(56) References Cited

U.S. PATENT DOCUMENTS

| | | | | |
|---|---|---|---|---|
| 10,477,936 | B2 * | 11/2019 | Doff | A45D 29/20 |
| 2004/0045568 | A1 * | 3/2004 | Abbott | A45D 29/22<br>132/73 |
| 2004/0089774 | A1 * | 5/2004 | Pace | A45D 34/00<br>248/146 |
| 2006/0145033 | A1 * | 7/2006 | McCombs | A47G 23/0241<br>248/106 |
| 2009/0229623 | A1 | 9/2009 | Fricker et al. | |
| 2010/0218780 | A1 * | 9/2010 | Hurman | A45D 29/20<br>132/73 |
| 2013/0087162 | A1 * | 4/2013 | Fitz | A45D 29/22<br>132/73 |
| 2016/0338517 | A1 * | 11/2016 | Snowden | A47G 23/06 |
| 2019/0307224 | A1 * | 10/2019 | Choekyi | A45D 29/20 |
| 2020/0113315 | A1 * | 4/2020 | Parker | A47F 7/0028 |

* cited by examiner

APPARATUS FOR HOLDING NAIL POLISH BOTTLES

BACKGROUND

The present disclosure relates generally to a beauty care apparatus, and, more particularly, to a nail grooming apparatus for storing a plurality of nail polish bottles therein and for enabling a user to conveniently perform nail grooming operations.

A nail grooming apparatus is one capable of storing a plurality of nail polish bottles in an organized manner. There exists a need for a nail grooming apparatus that can securely hold nail polish bottles on a user's lap or on a table while the apparatus is being utilized for carrying out nail grooming operations.

SUMMARY

Disclosed is a nail grooming apparatus comprising a flexible foam base having an upper surface and a lower surface. The upper surface has a plurality of slots configured thereon, the plurality of slots being adapted to each receive and secure therein a nail polish bottle in a utilization state of the nail polish bottle. The base of the nail grooming apparatus has an oval end view flat on the lower surface and convex on the upper surface, a bean shaped top view convex on one side and concave on the opposite side, and a banana shaped side view with a partially flattened bottom surface with upturned ends and a slightly concave upper surface. The top surface has an inner central oval area, the inner central oval area having a design feature.

An object of the nail grooming apparatus is to provide a portable means for one to apply polish to the fingernails while also providing a means for holding nail polish bottles where they can be utilized. The disclosed nail grooming apparatus has a form that is comfortable on a user's lap, but also stable. The disclosed nail grooming apparatus can also be used on other surfaces, like a table or an arm rest, for example. A user's hands can rest comfortably on the nail grooming apparatus without tipping the nail grooming apparatus forward or backward or to the side.

Figure 1:
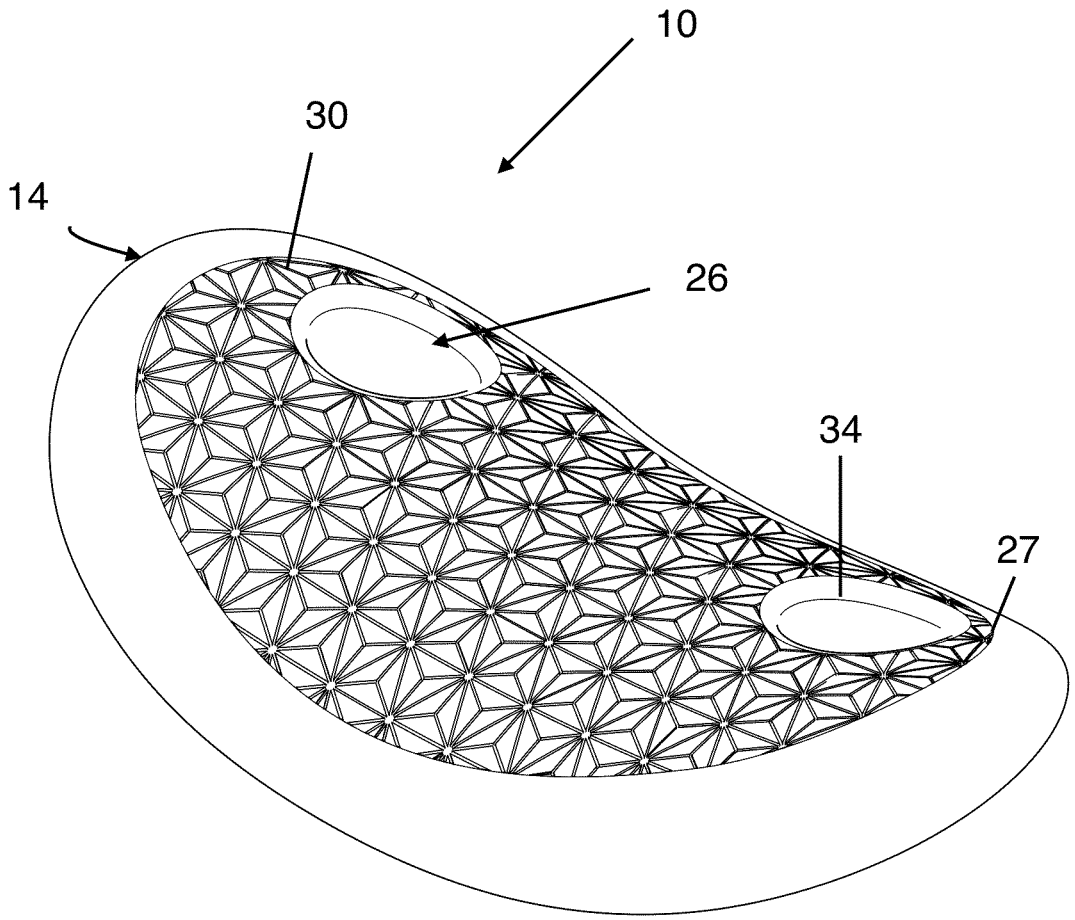
FIG. 1 is a left-side perspective view of a nail grooming apparatus with a design feature on the top surface of the nail grooming apparatus.

Before one embodiment of the disclosure is explained in detail, it is to be understood that the disclosure is not limited in its application to the details of the construction and the arrangements of components set forth in the following description or illustrated in the drawings. The disclosure is capable of other embodiments and of being practiced or being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof.

DESCRIPTION OF THE PREFERRED EMBODIMENT

Figure 2:
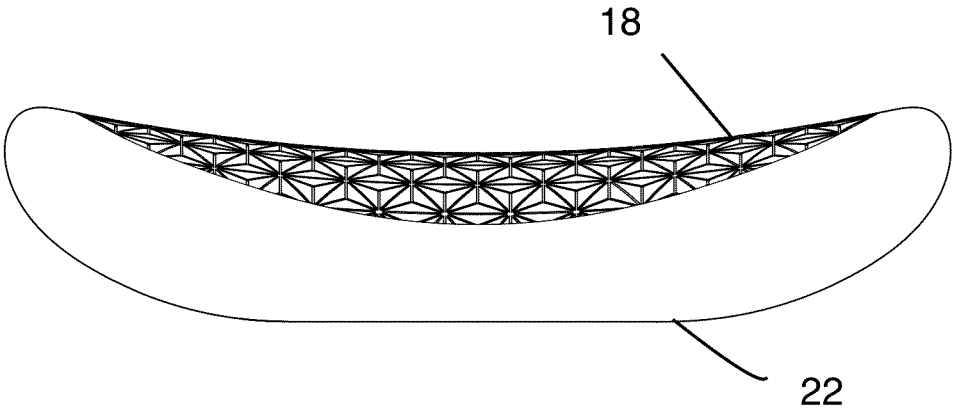
FIG. 2 is a front view of the nail grooming apparatus of FIG. 1.
Figure 3:
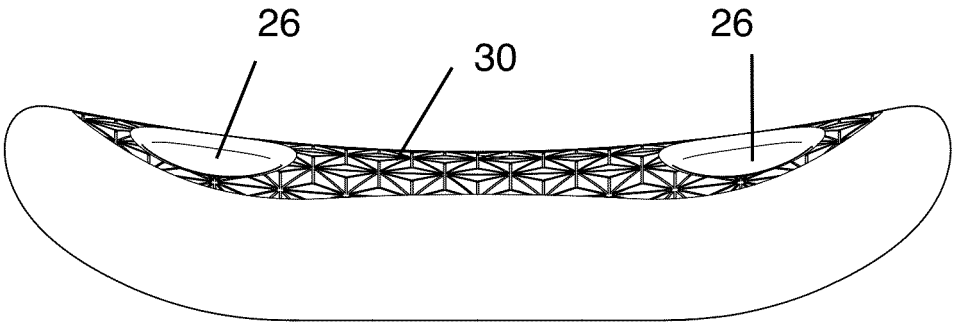
FIG. 3 is a rear view of the nail grooming apparatus of FIG. 1.
Figure 4:
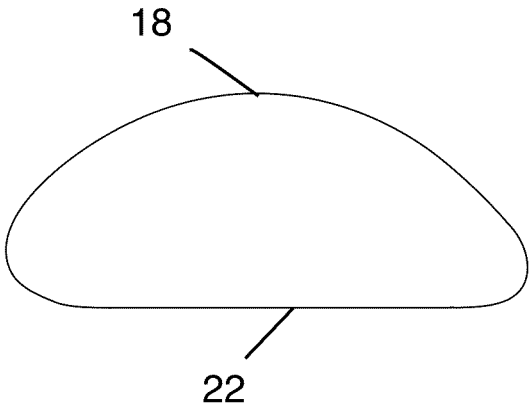
FIG. 4 is a right-side of the nail grooming apparatus of FIG. 1.
Figure 5:
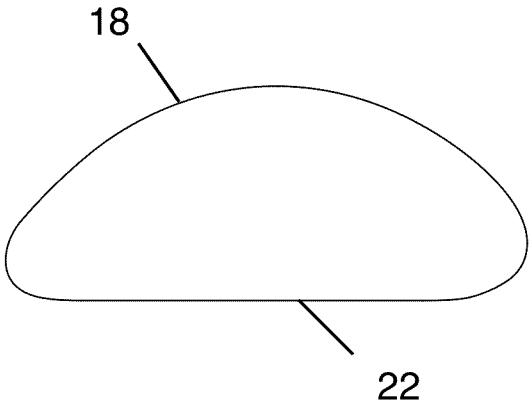
FIG. 5 is a left side of the nail grooming apparatus of FIG. 1.
Figure 6:
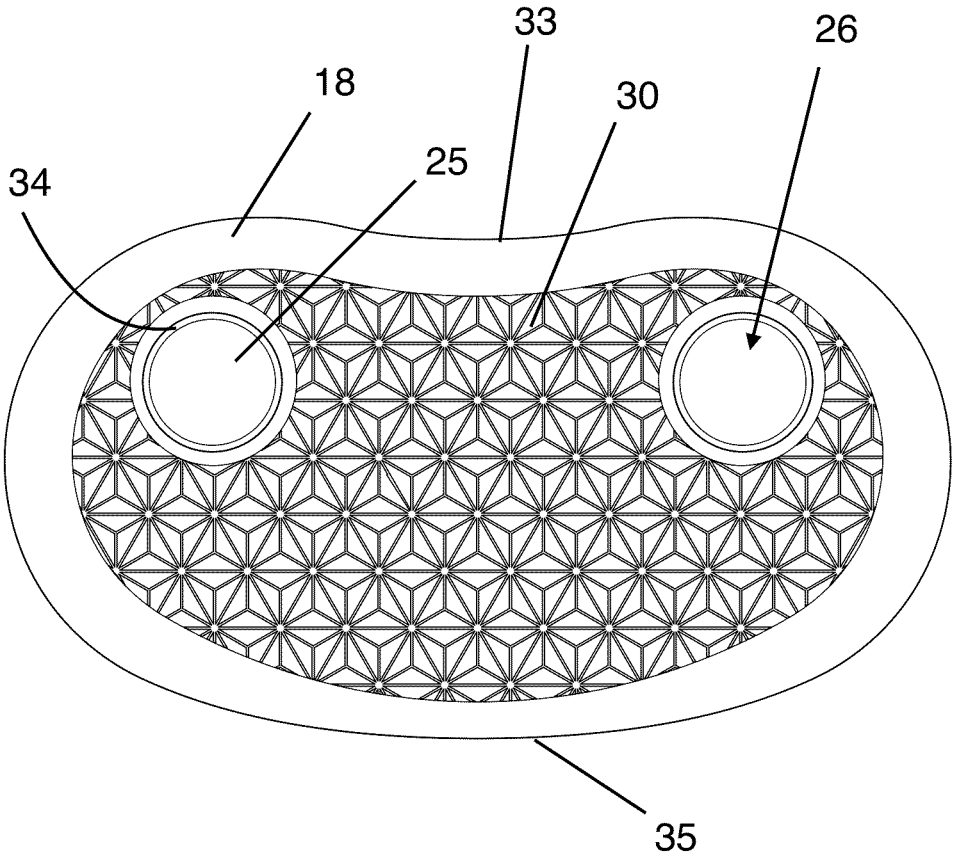
FIG. 6 is a top view of the nail grooming apparatus of FIG. 1.
Figure 7:
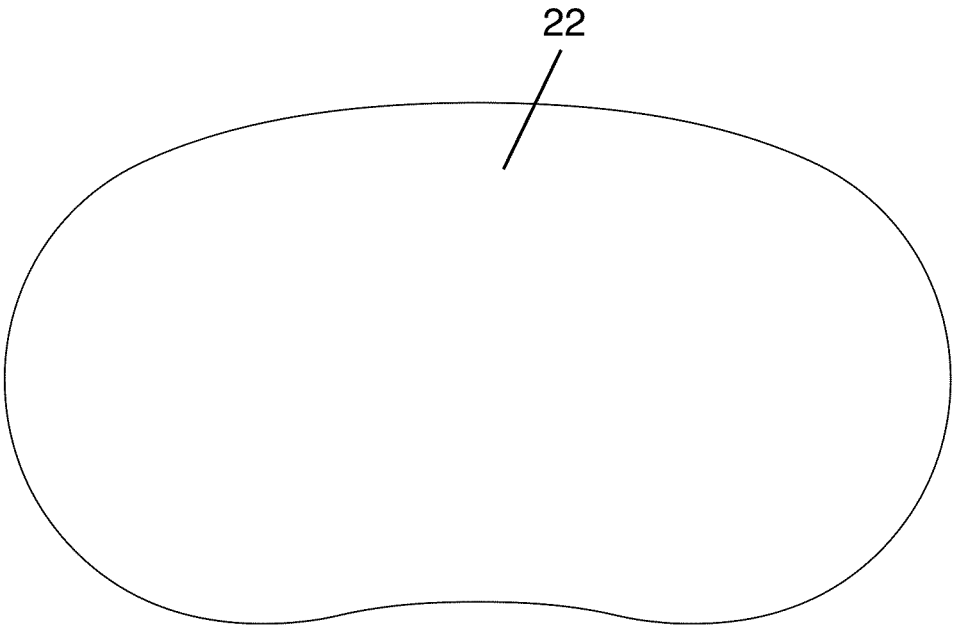
FIG. 7 is a bottom view of the nail grooming apparatus of FIG. 1.

As illustrated in FIGS. 1 to 7, disclosed is a nail grooming apparatus 10. The nail grooming apparatus 14 comprises a base 14 having an upper surface 18 (see FIG. 2) and a lower surface 22. The upper surface 18 has a plurality of slots 26 configured thereon, the plurality of slots 26 being adapted to each receive and secure therein a nail grooming article such as a nail polish bottle (not shown) in a utilization state of the nail polish bottle. In the preferred embodiment, there are two spaced apart slots 26 located within an inner central oval area 27. As used herein, a slot 26 is a narrow, elongated depression, groove, notch, slit, or aperture, especially a narrow opening for receiving or admitting nail polish bottles. Each slot 26 has a solid wall 25 at its bottom. In the preferred embodiment, the slots 26 are circular and beveled 34 where the top of the slots 26 met the top surface 18.

The upper surface 18 of the base 14 has a working region which is adapted to receive the hands of a user for enabling the user to perform nail grooming operations thereon.

The base 14 is spongy and made from a flexible foam, such as open cell foam or sponge rubber. In a preferred embodiment, the base 14 is molded from one piece of soft polyurethane foam.

The base 14 of the nail grooming apparatus 10 has an oval end view flat on the lower surface and convex on the upper surface 18, a bean shaped top view convex on one side 33 and concave on the opposite side 35, and a banana shaped side view with a partially flattened bottom surface 22 with upturned ends and a slightly concave upper surface 18.

The top surface 18 has the inner central oval area 27, the inner central oval area 27 having a design feature 30. The design feature 30, as illustrated, shows a design pattern, but in other embodiments, not shown, the design feature can be any of several different designs, such as a high school or college logo, a company logo, an advertising slogan, and so on. in other embodiments, not shown, the design feature can be a different texture or can be formed as a relief.

Various other features of this disclosure are set forth in the following claims.

The invention claimed is:

1. An apparatus for holding nail polish bottles, the apparatus comprising:

a spongy base having an upper surface and a lower surface, the upper surface having a plurality of depressions disposed thereon, wherein each depression of the plurality of depressions is adapted to receive and secure therein a nail polish bottle in a utilization state of the nail polish bottle, where, in end view, the spongy base is substantially oval and comprises a flat portion on the lower surface and a convex portion on the upper surface, and where, in top view, the spongy base is elongated and has a first side and a second side opposite the first side, where the first side is convex along its entirety and the second side comprises a single concave surface, and wherein the concave surface extends between a first and second depression of the plurality of depressions, and where, in side view, the spongy base is elongated and comprises a partially flattened portion with upturned, convex ends along the lower surface and a slight concavity along the upper surface, and wherein the upper surface has an inner central oval area, the inner central oval area having a design disposed thereon.

2. The apparatus of claim 1 wherein the first and second depression of the plurality of depressions are circular.

3. The apparatus of claim 1 wherein each depression of the plurality of depressions has a bevel where the upper surface of the spongy base adjoins the bevel.

4. The apparatus of claim 1 wherein the spongy base is molded from soft polyurethane foam.

5. The apparatus of claim 1 wherein the plurality of depressions are disposed within the inner central oval area.

6. An apparatus for holding nail polish bottles, the apparatus comprising:

a base molded from soft polyurethane foam having an upper surface and a lower surface, the upper surface having two spaced apart circular depressions disposed thereon, each depression having a bevel where the upper surface adjoins the depression, wherein the two depressions are adapted to each receive and secure therein a nail polish bottle in a utilization state of the nail polish bottle, the base having a substantially oval shape in end view with a flat portion on the lower surface and a convex portion on the upper surface, and where, in top view, the base is elongated and has a first side and a second side opposite the first side, where the first side is convex along its entirety and the second side comprises a single concave surface such that a concavity of the second side extends between the two depressions, and where, in side view, the base is elongated and comprises a partially flattened portion on the lower surface with upturned, convex ends and a slight concavity on the upper surface, and wherein the upper surface has an inner central oval area, the inner central oval area having a design disposed thereon, the two depressions being within the inner central oval area.

* * * * *